US007465359B2

(12) United States Patent
Vives-Martinez

(10) Patent No.: US 7,465,359 B2
(45) Date of Patent: Dec. 16, 2008

(54) GAME TICKET SCRATCHING DEVICE AND METHOD

(76) Inventor: Walter J. Vives-Martinez, 15701 SW. 137 Ave. #103, Miami, FL (US) 33177

( * ) Notice: Subject to any disclaimer, the term of this patent is extended or adjusted under 35 U.S.C. 154(b) by 799 days.

(21) Appl. No.: 10/987,909

(22) Filed: Nov. 15, 2004

(65) Prior Publication Data

US 2006/0102199 A1 May 18, 2006

(51) Int. Cl.

| | |
|---|---|
| ***B08B 7/00*** | (2006.01) |
| ***B08B 7/04*** | (2006.01) |
| ***B08B 5/04*** | (2006.01) |
| ***A46B 13/00*** | (2006.01) |
| ***A46B 13/04*** | (2006.01) |

(52) U.S. Cl. ..... 134/21; 134/6; 134/42; 134/902; 15/22.3; 15/23; 15/24; 15/344

(58) Field of Classification Search ..... 134/6, 134/21, 38, 42, 902; 15/22.1, 22.3, 23, 24, 15/28, 29, 344, 352, 383

See application file for complete search history.

(56) References Cited

U.S. PATENT DOCUMENTS

| | | | | |
|---|---|---|---|---|
| 4,389,132 | A | 6/1983 | Valadez | |
| 4,646,382 | A | 3/1987 | Smith | |
| 5,402,549 | A * | 4/1995 | Forrest | 15/88.3 |
| D389,965 | S | 1/1998 | Saladino | |
| 5,794,303 | A * | 8/1998 | Sanfilippo et al. | 15/344 |
| 6,065,181 | A * | 5/2000 | Cleveland et al. | 15/344 |
| 6,261,016 | B1 * | 7/2001 | Liu | 401/116 |
| 2002/0054783 | A1 | 5/2002 | Gueret | |

* cited by examiner

*Primary Examiner*—Alexander Markoff
*Assistant Examiner*—Nicole Blan

(57) ABSTRACT

A game ticket scratching device and method includes an elongated tubular member that has an open first end and a closed second end. An axle is mounted within the tubular member adjacent to the first end. A plurality of bristles is attached to and radially extends outwardly away from the axle. A motor is mounted within the housing and is mechanically coupled to the axle. A power supply electrically coupled to the motor. An actuator is operationally coupled to the power supply for selectively turning the power supply on or off. The power supply is turned on so that the axle rotates. The bristles are abutted against a lottery ticket concealing layer so that the bristles scrape the concealing layer off of the game card.

4 Claims, 3 Drawing Sheets

GAME TICKET SCRATCHING DEVICE AND METHOD

BACKGROUND OF THE INVENTION

1. Field of the Invention

The present invention relates to game ticket scratching devices and more particularly pertains to a new game ticket scratching device for scraping lottery tickets.

2. Description of the Prior Art

The use of game ticket scratching devices is known in the prior art. U.S. Pat. No. 6,056,181 describes a device having an end for scratching a ticket and a fan therein for pulling the scratched debris into a housing. Another type of game ticket scratching device is U.S. Pat. No. 5,793,303 that again includes an adapted for scratching a ticket and for pulling the debris into a housing. U.S. Pat. No. 4,646,382 includes a device having an unique shape for scratching a lottery ticket.

While these devices fulfill their respective, particular objectives and requirements, the need remains for a device that is well adapted for removing the opaque coating, typically made of a latex material, that is positioned on a lottery ticket for covering game chance. The device is preferably an automated scratching device so that the user of the device need not do the scraping of the coating.

SUMMARY OF THE INVENTION

The present invention meets the needs presented above by generally comprising an elongated tubular member that has an open first end and a closed second end. An axle is mounted within the tubular member. The axle is positioned adjacent to the first end. The axle is orientated perpendicular to a longitudinal axis of the tubular member. A plurality of bristles is attached to and radially extends outwardly away from the axle. The bristles extending toward the first end are extended outwardly of the first end. A motor is mounted within the housing and is mechanically coupled to the axle. The motor rotates the axle when turned on. A power supply electrically coupled to the motor. An actuator is operationally coupled to the power supply for selectively turning the power supply on or off. The power supply is turned on so that the axle rotates. The bristles are abutted against a lottery ticket concealing layer so that the bristles scrape the concealing layer off of the game card. When complete, the power supply is turned off.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
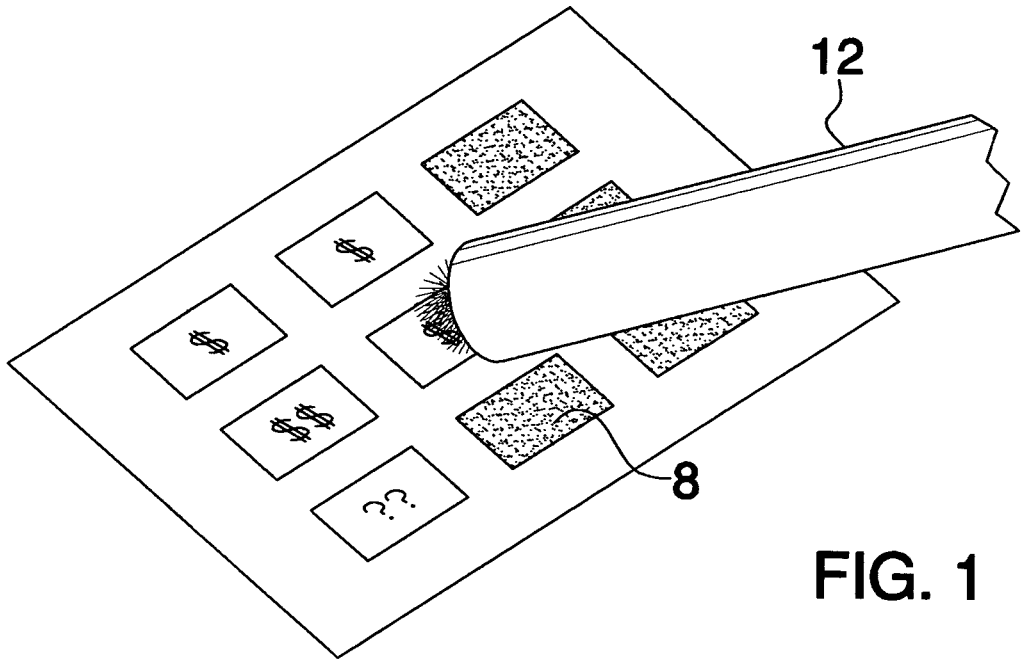
FIG. 1 is a perspective in-use view of a game ticket scratching device and method according to the present invention.
Figure 2:
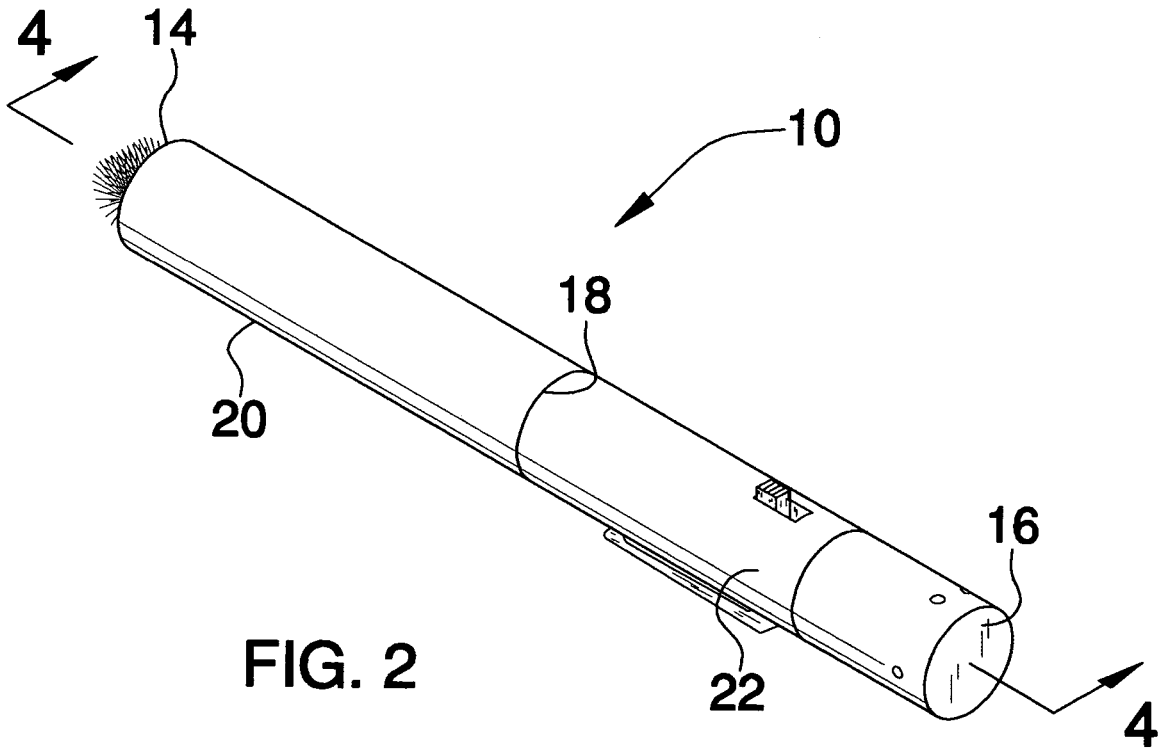
FIG. 2 is a perspective view of the present invention.
Figure 3:
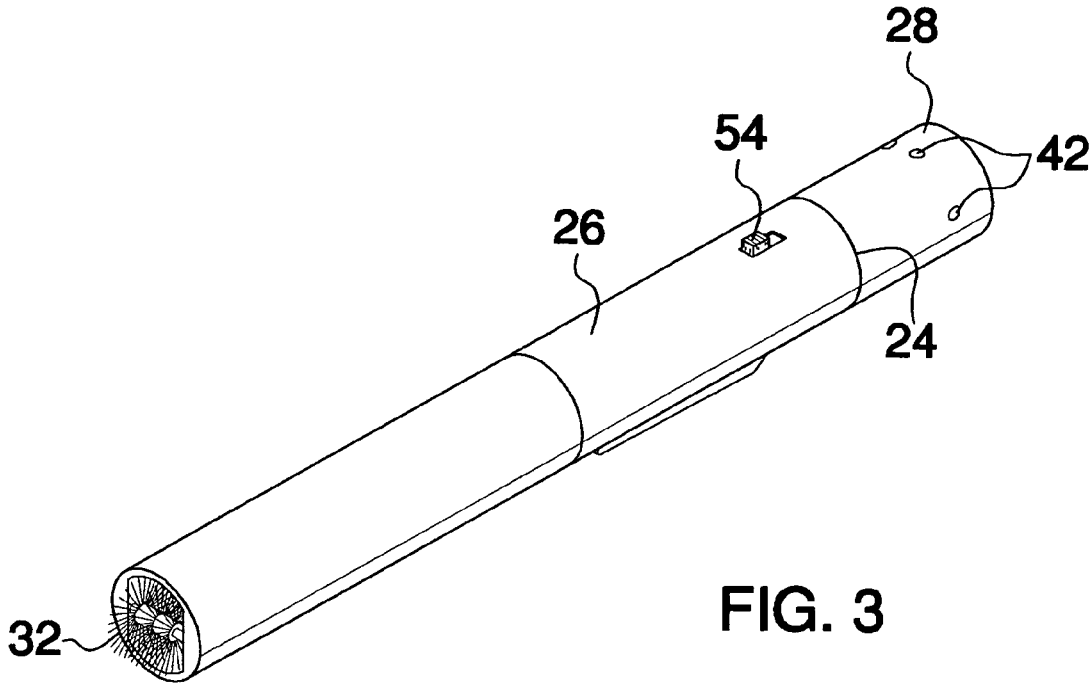
FIG. 3 is a perspective view of the present invention.
Figure 4:
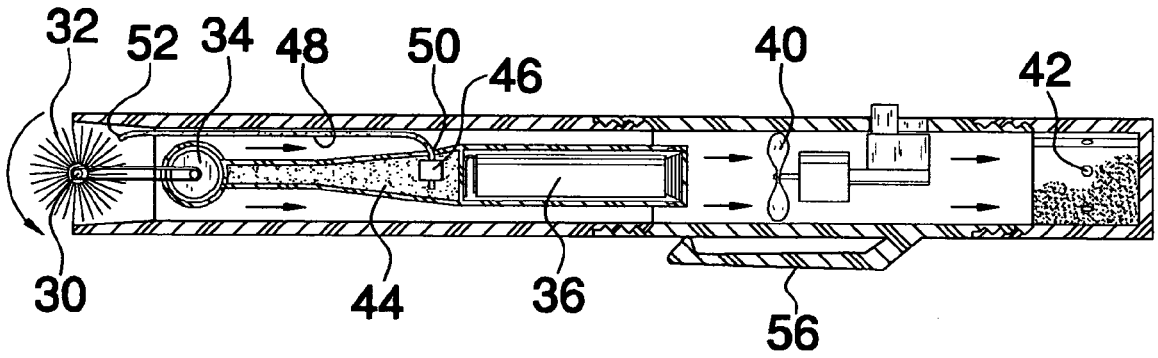
FIG. 4 is a cross-sectional view taken along line 4-4 of FIG. 2 of the present invention.

With reference now to the drawings, and in particular to FIGS. 1 through 6 thereof, a new game ticket scratching device embodying the principles and concepts of the present invention and generally designated by the reference numeral 10 will be described.

As best illustrated in FIGS. 1 through 6, the game ticket scratching device and method 10 generally comprises an elongated tubular member 12 that has an open first end 14 and a closed second end 16. The tubular member 12 has a primary break 18 therein positioned generally between the first 14 and second 16 ends so that a first portion 20 and a second portion 22 of the elongated tubular member 12 are defined. The first 20 and second 22 portions are threadably couplable to each other. The tubular member 12 has a secondary break 24 therein positioned in the second portion 22 so that a first section 26 and a second section 28 of the second portion 22 are defined. The second section 28 abuts the second end 16. The first 26 and second 28 sections are threadably couplable to each other.

An axle 30 is mounted within the tubular member 12. The axle 30 is positioned adjacent to the first end 14 and is orientated perpendicular to a longitudinal axis of the tubular member 12. Each of a plurality of bristles 32 is attached to and radially extends outwardly away from the axle 30. The bristles 32 extending toward the first end 14 extend outwardly of the first end 14. The bristles 32 are preferably made of a metallic material or a rigid plastic material.

A motor 34 is mounted within the tubular member 12 and is mechanically coupled to the axle 30, such as with a belt or gear. The motor 34 rotates the axle 30 when the motor 34 is turned on. The motor 34 is mounted in the first portion 20 of the tubular member 12. A power supply 36 electrically coupled to the motor 34. The power supply 36 preferably comprises a battery that is removably mounted in the tubular member 12 and is generally positioned at a juncture of the first 20 and second 22 portions. Alternatively, the power supply 36 may include a power plug for plugging into an outlet.

An air movement assembly 38 is mounted in the second portion 22 and is adapted for drawing air into the first end 1 4 and toward the second end 16. The air movement assembly 38 is electrically coupled to the power supply 36. The air movement assembly 38 includes a propeller 40 for drawing air into the tubular member 12. A plurality of venting apertures 42 extends through the tubular member 12 for allow for airflow into the first end 14.

A fluid housing 44 is mounted within the tubular member 12. The fluid housing 44 has a solvent contained therein. The solvent may include any conventional solvent used for dissolving latex. A pump 46 is in fluid communication with the fluid housing 44 and is electrically coupled to the power supply 36. A delivery conduit 48 has a first end 50 fluidly coupled to the pump 46 and a second end 52 positioned adjacent to the axle 30 so that solvent pumped through the conduit 48 is ejected toward the axle 30.

An actuator 54 is operationally coupled to the power supply 36 for selectively turning the power supply 36 on or off. The actuator 54 is mounted on an outer surface of the tubular member 12. A clip 56 may also be attached to the tubular member 12 for storage purposes.

In use, the power supply is turned on so that that the axle 30 rotates to spin the bristles 32 with respect to the tubular member 12. The bristles 32 are abutted against a lottery game card ticket concealing layer 8 so that the bristles 32 scrape the concealing layer 8 off of the game card. The air movement assembly 38 sucks debris from the bristles 32 and into the tubular member 12. The solvent aids the process by dissolving the concealing layer 8. The power supply 36 is then turned off and the second section 28 is removed from the first section 26 and the debris contained within the second section 28 is discarded.

Figure 5:
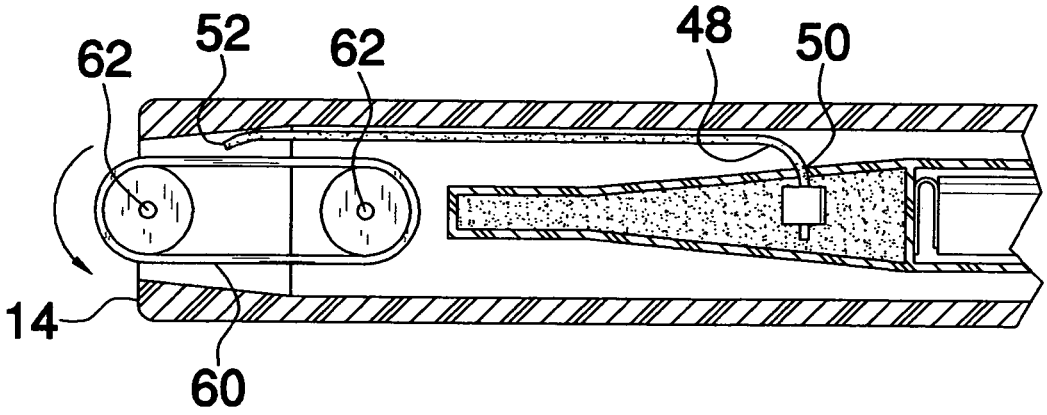
FIG. 5 is a cross-sectional view of a second embodiment of the present invention.
Figure 6:
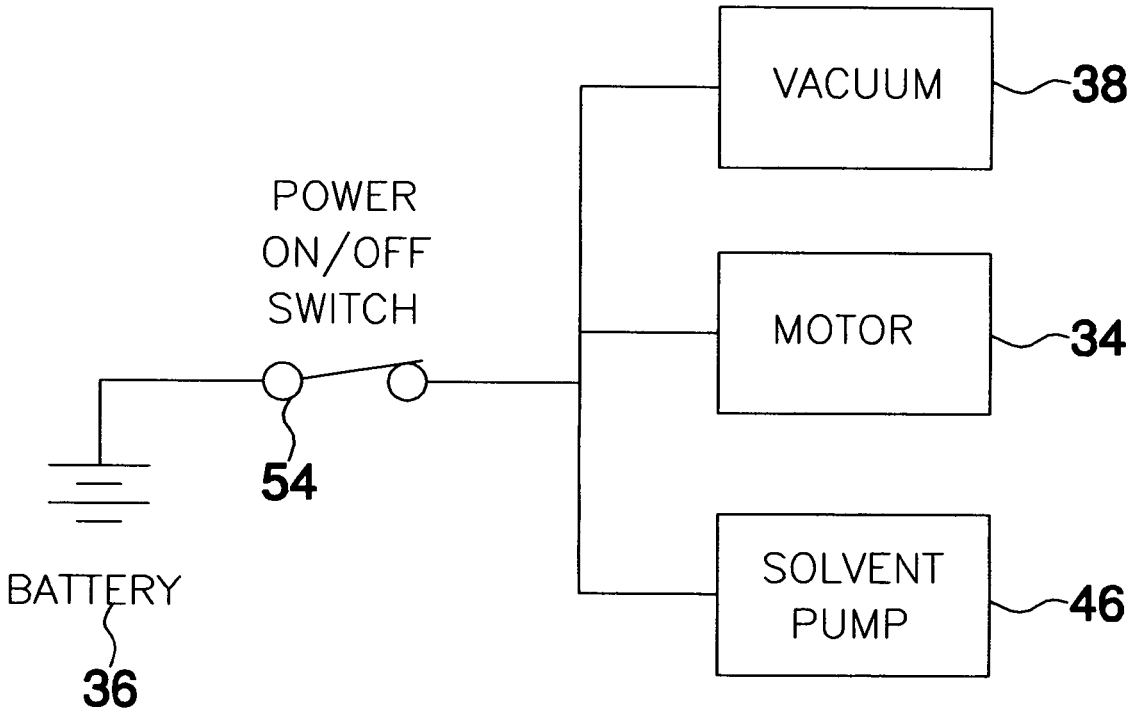
FIG. 6 is a schematic view of the present invention.

A second embodiment is shown in FIG. 5 and includes a band 60 or belt that is rotated around a pair of axles 62 and which extends outwardly of the first end 14. The band 60 is positioned against the concealing layer 8 and is rotated by the motor 34 to remove the concealing layer 8.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method for removing a concealing layer off of a game card, said method comprising the steps of:

providing an elongated tubular member having an open first end and a closed second end;

providing an axle being mounted within said tubular member, said axle being positioned adjacent to said first end, said axle being orientated perpendicular to a longitudinal axis of said tubular member, a plurality of bristles being attached to and radially extending outwardly away from said axle, said bristles extending toward said first end being extended outwardly of said first end;

providing a motor mounted within said tubular member and being mechanically coupled to said axle, said motor rotating said axle when said motor is turned on;

providing a power supply electrically coupled to said motor;

providing an actuator operationally coupled to said power supply for selectively turning said power supply on or off;

providing a fluid housing mounted within said tubular member, said fluid housing having a solvent contained therein, a pump being in fluid communication with said fluid housing, said pump being electrically coupled to said power supply, a delivery conduit having a first end fluidly coupled to said pump and a second end positioned adjacent to said axle such that solvent pumped through said conduit is ejected toward said axle;

turning on said power supply such that said axle rotates;

abutting said bristles against the concealing layer such that said bristles scrape said concealing layer off of the game card;

dissolving said concealing layer with said solvent when said power supply is turned on; and turning off said power supply.

2. The method according to claim 1, wherein said tubular member has a primary break therein positioned generally between said first and second ends such that a first portion and a second portion of said elongated tubular member are defined, said first and second portions being threadably couplable to each other, said power supply being removably mounted in said tubular member and being generally positioned at a juncture of said first and second portions.

3. The method according to claim 2, further including the steps of:

wherein said tubular member has a secondary break therein positioned in said second portion such that a first section and a second section of said second portion are defined, said second section abutting said second end, said first and second sections being threadably couplable to each other;

providing an air movement assembly being mounted in said second portion and adapted for drawing air into said first end and toward said second end, said air movement assembly being electrically coupled to said power supply;

sucking debris from said bristles to said second section by said air movement assembly when said power supply is turned on;

removing said second section from said first section and discarding said debris after said power supply has been turned off.

4. A method for removing a concealing layer off of a game card, said method comprising the steps of:

providing an elongated tubular member having an open first end and a closed second end, said tubular member having a primary break therein positioned generally between said first and second ends such that a first portion and a second portion of said elongated tubular member are defined, said first and second portions being threadably couplable to each other, said tubular member having a secondary break therein positioned in said second portion such that a first section and a second section of said second portion are defined, said second section abutting said second end, said first and second sections being threadably couplable to each other;

providing an axle being mounted within said tubular member, said axle being positioned adjacent to said first end, said axle being orientated perpendicular to a longitudinal axis of said tubular member, a plurality of bristles being attached to and radially extending outwardly away from said axle, said bristles extending toward said first end being extended outwardly of said first end;

providing a motor mounted within said tubular member and being mechanically coupled to said axle, said motor rotating said axle when said motor is turned on, said motor being mounted in said first portion of said tubular member;

providing a power supply electrically coupled to said motor, said power supply being removably mounted in said tubular member and being generally positioned at a juncture of said first and second portions;

providing an air movement assembly being mounted in said second portion and adapted for drawing air into said first end and toward said second end, said air movement assembly being electrically coupled to said power supply;

providing a fluid housing mounted within said tubular member, said fluid housing having a solvent contained therein, a pump being in fluid communication with said fluid housing, said pump being electrically coupled to said power supply, a delivery conduit having a first end fluidly coupled to said pump and a second end positioned adjacent to said axle such that solvent pumped through said conduit is ejected toward said axle;

providing an actuator operationally coupled to said power supply for selectively turning said power supply on or off;

turning on said power supply such that said axle rotates;

abutting said bristles against the concealing layer such that said bristles scrape said concealing layer off of the game card;

sucking debris from said bristles to said second section by said air movement assembly;

dissolving said concealing layer with said solvent;

turning off said power supply; and removing said second section from said first section and discarding said debris.

* * * * *